United States Patent [19]

Eaton

[11] Patent Number: 4,681,711

[45] Date of Patent: Jul. 21, 1987

[54] METHOD AND APPARATUS FOR AERATION OF WASTEWATER LAGOONS

[76] Inventor: John M. Eaton, P.O. Box 666, Safford, Ariz. 85548

[21] Appl. No.: 860,332

[22] Filed: May 6, 1986

[51] Int. Cl.[4] ..... B01F 3/04

[52] U.S. Cl. ..... 261/91; 210/242.2; 261/120

[58] Field of Search ..... 261/91, 120; 210/242.2; 209/169

[56] References Cited

U.S. PATENT DOCUMENTS

| | | | |
|---|---|---|---|
| 1,761,136 | 6/1930 | Lord | 261/93 |
| 1,989,589 | 1/1935 | Fischer et al. | 261/91 |
| 2,165,889 | 7/1939 | Fischer et al. | 261/93 |
| 2,573,520 | 10/1951 | Wasley et al. | 209/169 |
| 3,218,042 | 11/1965 | Cibattari et al. | 261/120 |
| 3,273,865 | 9/1966 | White | 261/91 |
| 3,307,697 | 3/1967 | Fahlstrom et al. | 209/169 |
| 3,360,460 | 12/1967 | Weston | 261/91 |
| 3,491,880 | 1/1970 | Reck | 261/93 |
| 3,497,185 | 2/1970 | Dively | 261/36 |
| 3,521,864 | 7/1970 | Welles, Jr. | 261/77 |
| 3,548,770 | 12/1970 | Boutros | 261/120 |
| 3,669,422 | 6/1972 | Nogaj | 261/34 |
| 3,680,845 | 8/1972 | Carlsmith et al. | 261/37 |
| 3,796,414 | 3/1974 | Winton | 261/91 |
| 3,846,516 | 11/1974 | Carlson | 261/87 |
| 3,856,272 | 12/1974 | Ravitts | 259/95 |
| 3,940,461 | 2/1976 | Martin et al. | 261/91 |
| 4,190,619 | 2/1980 | Cherne | 210/242.2 |
| 4,193,951 | 3/1980 | Stanley | 261/91 |
| 4,308,137 | 12/1981 | Freeman | 210/242.2 |
| 4,350,648 | 9/1982 | Watkins, III et al. | 261/120 |
| 4,482,510 | 11/1984 | Khudenko | 261/120 |
| 4,543,185 | 9/1985 | Reid | 210/194 |

*Primary Examiner*—Tim Miles

*Attorney, Agent, or Firm*—Cahill, Sutton & Thomas

[57] ABSTRACT

A motor supported by a float drives an impeller having eight symmetrically oriented vertical vanes radially attached to a cylindrical hub submerged below the surface of a wastewater lagoon. The size, position, and rotation rate of the impeller are selected to centrifugally expel wastewater between the vanes and cause a vacuum therebetween. An air vortex is produced between the lagoon surface and the top of the impeller, drawing air along the shaft of the impeller into the vacuum region. The incoming air and water is "sheared" by the vanes, causing great turbulence producing a mixture of water with millions of minute air bubbles entrained which is centrifugally thrown outward by the impeller, producing a deep, large radius zone of influence. The minute bubbles remain in the wastewater for a relatively long period of time, greatly improving dissolved oxygen levels. An air screw device disposed in the air vortex region increases the efficiency of the device.

15 Claims, 9 Drawing Figures

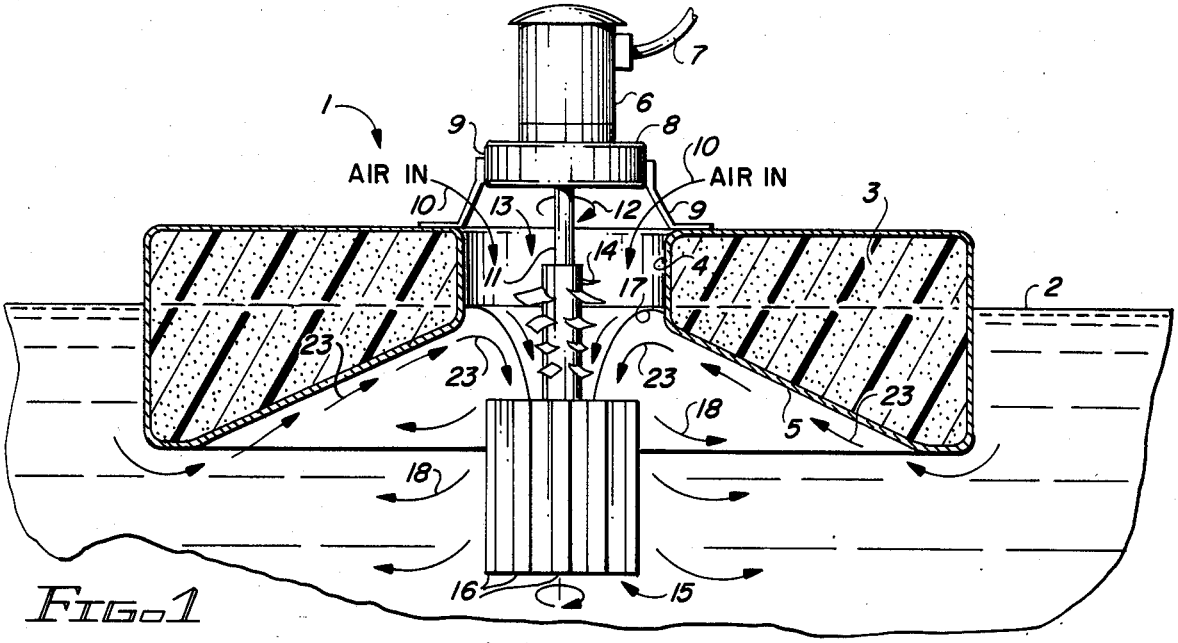
FIG. 1
FIG. 2
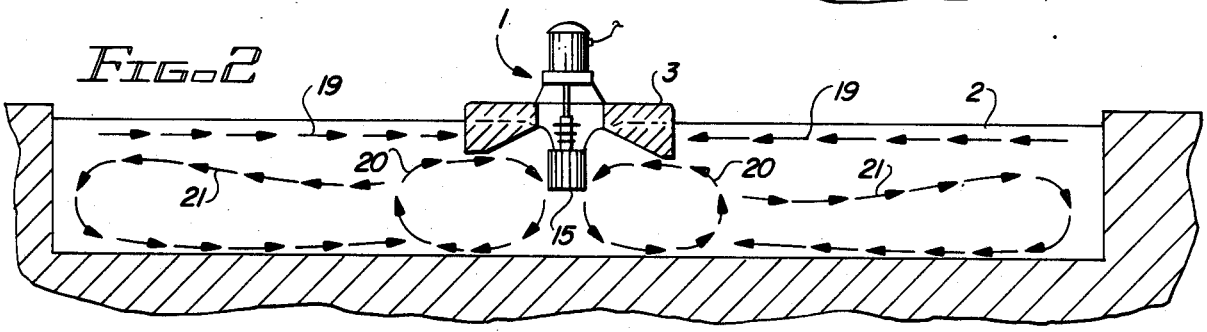
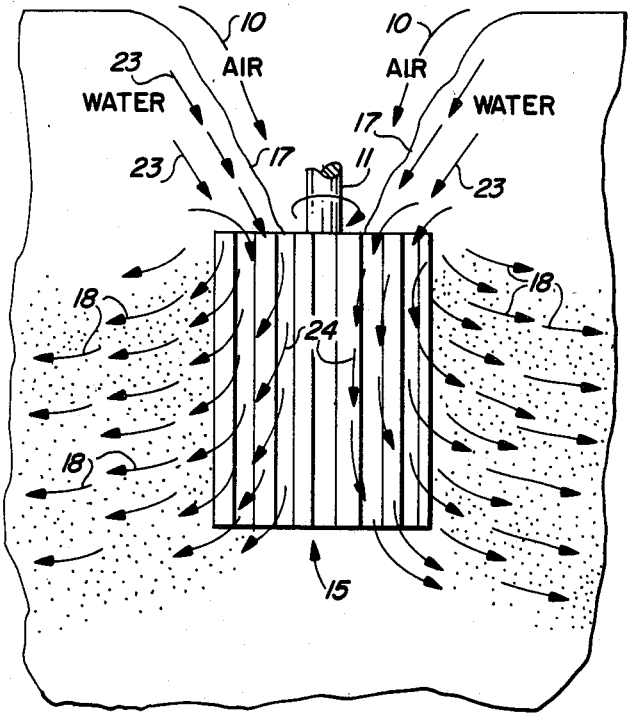
FIG. 3
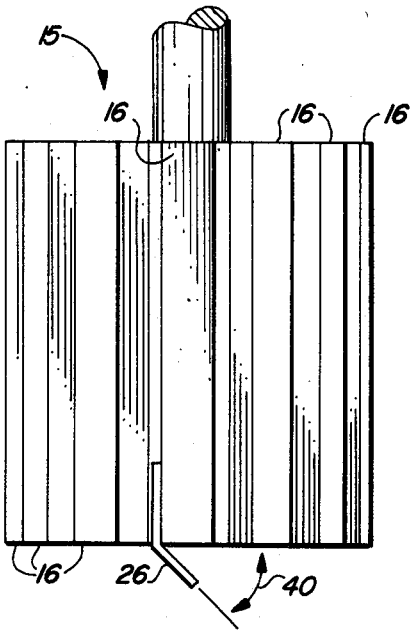
FIG. 4

FIG. 5
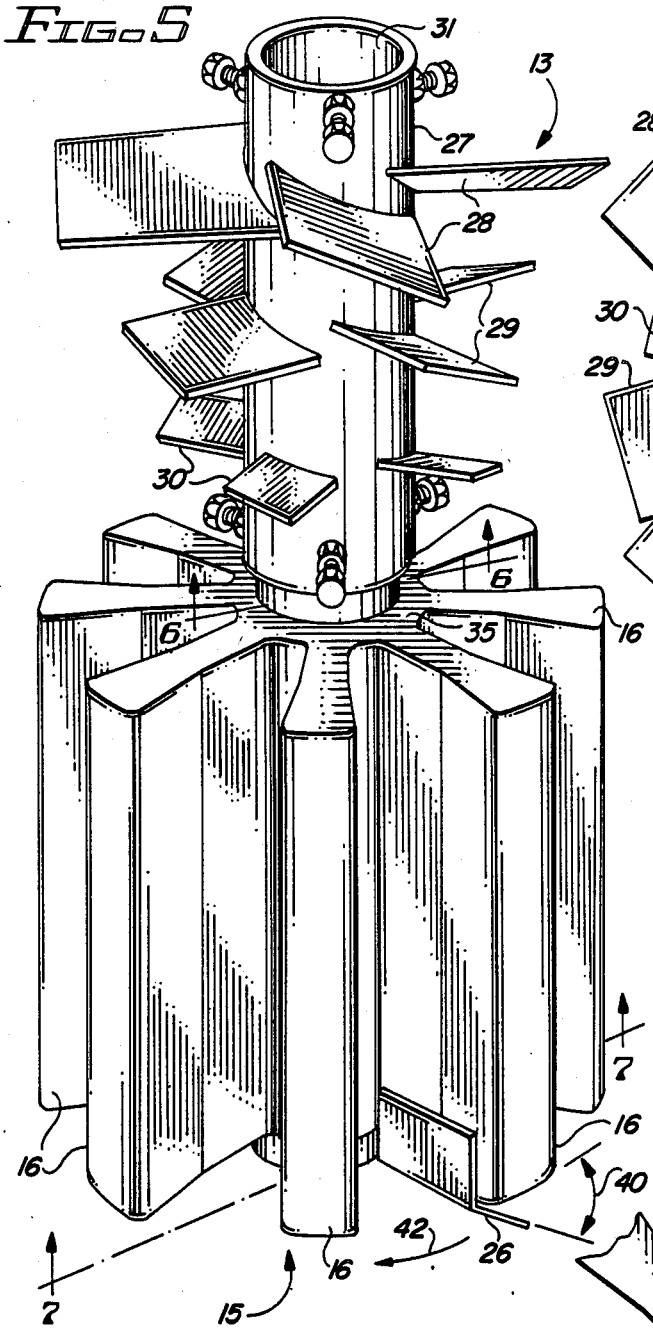
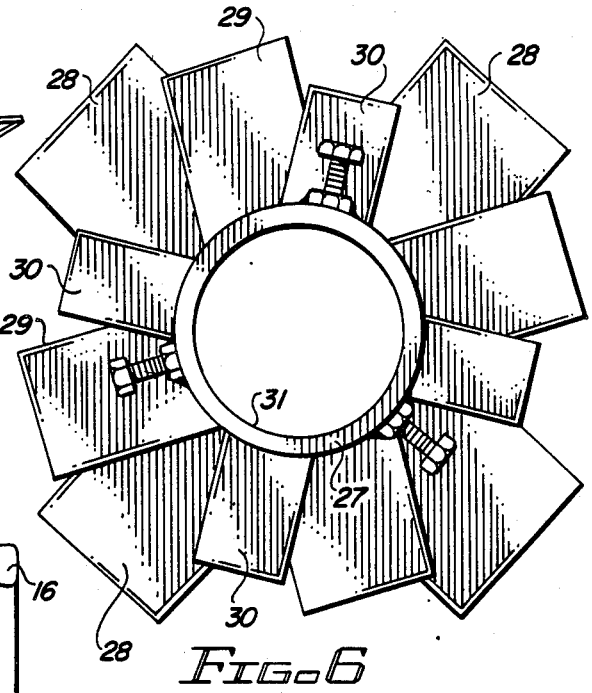
FIG. 6
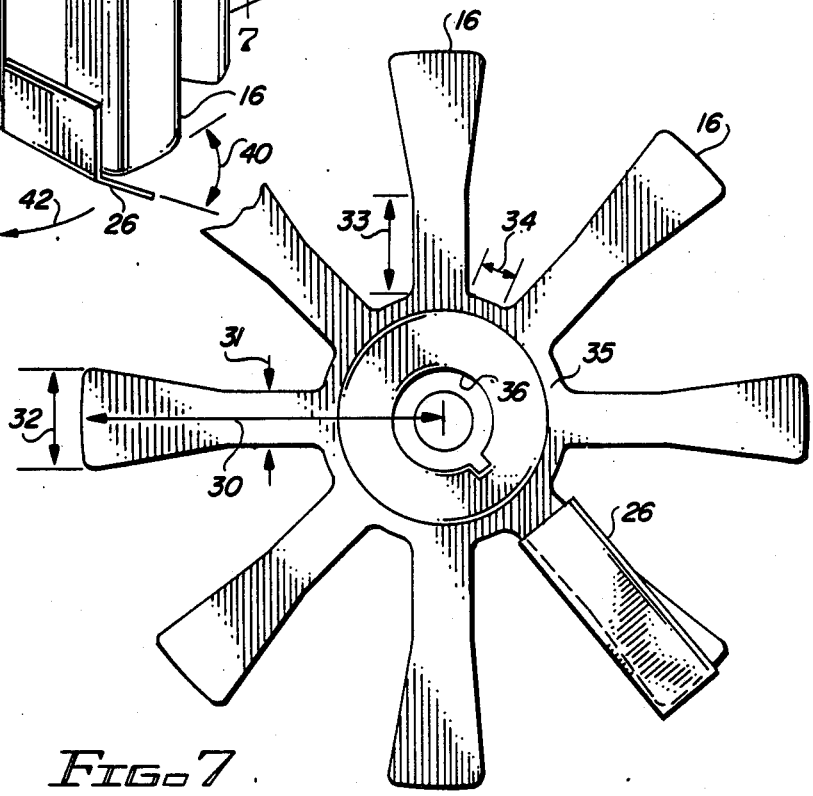
FIG. 7

METHOD AND APPARATUS FOR AERATION OF WASTEWATER LAGOONS

BACKGROUND OF THE INVENTION

The invention relates to apparatus and methods for aeration of wastewater, and more particularly to improvements that increase the zone of influence, and greatly increase the amount of oxygen transferred to the wastewater per horsepower of energy required.

Wastewater from both municipal sewage systems and from industrial waste product exhausting systems is usually collected in large ponds that are referred to as wastewater lagoons. Such lagoons may be 5 to 15 feet deep and may cover quite a number of acres of surface area. The wastewater usually includes large amounts of organic and inorganic waste material that, if left untreated, creates severe odors and generates toxic products. Seapage of toxic products in wastewater lagoons into ground water reservoirs and the resulting contamination is a serious problem that only recently is receiving grudging attention from many municipal governments.

Any wastewater lagoon has a basic requirement for an amount of oxygen that must be dissolved to prevent the lagoon from "turning sour", or becoming anaerobic. With its basic oxygen demand (BOD) being met by dissolving a minimum amount of oxygen into the wastewater, the sewage will undergo biodegradation that converts the wastewater into a relatively nontoxic, nonoffensive effluent. If the basic oxygen demand is not met, sludge deposits build up on the bottom, causing odors and toxic conditions that become progressively worse, increasing the spread of the resulting contamination both through the air and ground water seepage. Municipal governments often have ignored the problem as much as possible, due to the very high cost of prior techniques of introducing enough oxygen into the wastewater lagoons to meet the BOD requirements. Various approaches have been used, typically by surface aeration or by submerged aeration systems wherein air is pumped below the surface of the water, sometimes below a rotating impeller that shears the rising air into smaller bubbles and mixes the wastewater and entrained air. Both radial flow and axial flow impellers have been used, as indicated in U.S. Pat. No. 3,846,516. The state-of-the-art also is indicated in U.S. Pat. Nos. 4,543,185 and 3,521,864.

Various mixing devices are known for mixing finely ground ore with leaching ores. One such mixing device that has been in use for about 50 years uses an impeller similar to the impeller of the wastewater aeration apparatus of my invention. The impeller of the ore mixing device causes air to be incidentally mixed with the finely ground ore and leaching fluids.

All of the installed prior systems of which I am aware for aeration of wastewater have consumed tremendously large amounts of electrical power to run the pumps associated therewith, and have performed below initial expectations of the users. In a number of instances of which I am aware, wastewater aeration systems costing millions of dollars have been installed, and when operated have consumed tremendously large amounts of electricity, yet have failed to raise the dissolved oxygen level in the wastewater lagoons to an acceptable level, and in some cases have been shut down in a short time due to their ineffectiveness and/or cost.

It is clear that there is a great long-existing, unmet need for an apparatus and method for aerating wastewater lagoons that are much less expensive to install and operate than prior wastewater aeration systems, and which are much more efficient with respect to amount of oxygen dissolved per unit volume of wastewater per unit of required operating energy.

SUMMARY OF THE INVENTION

Accordingly, it is an object of the invention to provide a method and apparatus for aerating wastewater that dissolves a much greater amount of oxygen in wastewater per unit of required operating energy required than prior wastewater aeration devices.

It is another object of the invention to provide a wastewater aeration apparatus and method that produce minute air bubbles that remain entrained in the wastewater much longer than is the case for prior apparatus and methods.

It is another object of the invention to provide a wastewater aeration method and apparatus that is much less expensive to manufacture and install than any prior wastewater aeration apparatus having comparable capability of dissolving oxygen in wastewater.

It is another object of the invention to provide a wastewater aeration apparatus that produce a "scouring" action that results in removal and degradation of sludge that has settled on the bottom of a wastewater lagoon.

Briefly described, and in accordance with one embodiment thereof, the invention provides a wastewater aeration apparatus and method for introducing millions of minute air bubbles into a wastewater pond or lagoon and mixing the wastewater with minute air bubbles throughout a large region of influence surrounding the aeration apparatus, by rotating an impeller having a plurality of symmetrical, radial vertical vanes positioned a predetermined distance below the surface of the wastewater, at a rate that produces an air vortex which is drawn downward into vacuum regions produced between the vanes as a result of centrifugal expulsion of water therebetween. The air and water drawn into the vacuum regions are sheared, causing a high degree of mixing of the inflowing wastewater and air. The mixture of water and millions of minute air bubbles is centrifugally expelled radially outward by the impeller, creating a radial outward subsurface current of the mixture of water and minute bubbles. In the described embodiment of the invention, an air screw is disposed on a shaft supporting the impeller, with air screw fins enhancing flow of air downward through the vortex into the vacuum in the regions between the impeller blades, further increasing the efficiency of the aeration apparatus and method. The impeller shaft is driven by an electric motor/gear reduction assembly supported on a float. In one described embodiment of the invention, the float has an annular configuration with a concave bottom surface. The mixture of water and minute bubbles expelled radially outward by the impeller is guided downward by the concave bottom surfaces of the float. In another embodiment, the float includes four elongated float elements oriented generally radially outwardly from the motor and impeller. The minute bubbles remain in the wastewater for a relatively long period of time, and expose a great deal of air bubble surface area to the wastewater, resulting in a great improvement in efficiency of oxygen transfer into the wastewater per unit of power utilized to drive the impeller. The area of influence surrounding the apparatus in the wastewater lagoon is substantially greater than for prior aeration devices that consume much greater amounts of electrical power to drive their impellers or pump air bubbles into the wastewater. The depth of influence of the apparatus is great enough to result in a "scouring action" that stirs up and mixes oxygen with sludge that has settled on the bottom of a wastewater lagoon.

BRIEF DESCRIPTION OF THE DRAWINGS

FIG. 1 is a partial section view illustrating the aeration apparatus of the present invention.

FIG. 2 is a section view useful in describing the currents of the mixture of wastewater and minute air bubbles generated by the aeration device of the present invention in a shallow wastewater lagoon.

FIG. 3 is an enlarged partial section view useful in explaining the mechanics of entraining millions of minute bubbles with wastewater by rotation of the impeller of the aeration device of the present invention.

FIG. 4 is a partial side view illustrating an alternate embodiment of the impeller of the present invention.

FIG. 5 is a perspective view illustrating the impeller and air screw of one embodiment of the invention.

FIG. 6 is a top view of the air screw shown in FIG. 5.

FIG. 7 is a partial section view taken along section line 7—7 of FIG. 5.

DESCRIPTION OF THE INVENTION

Figure 8:
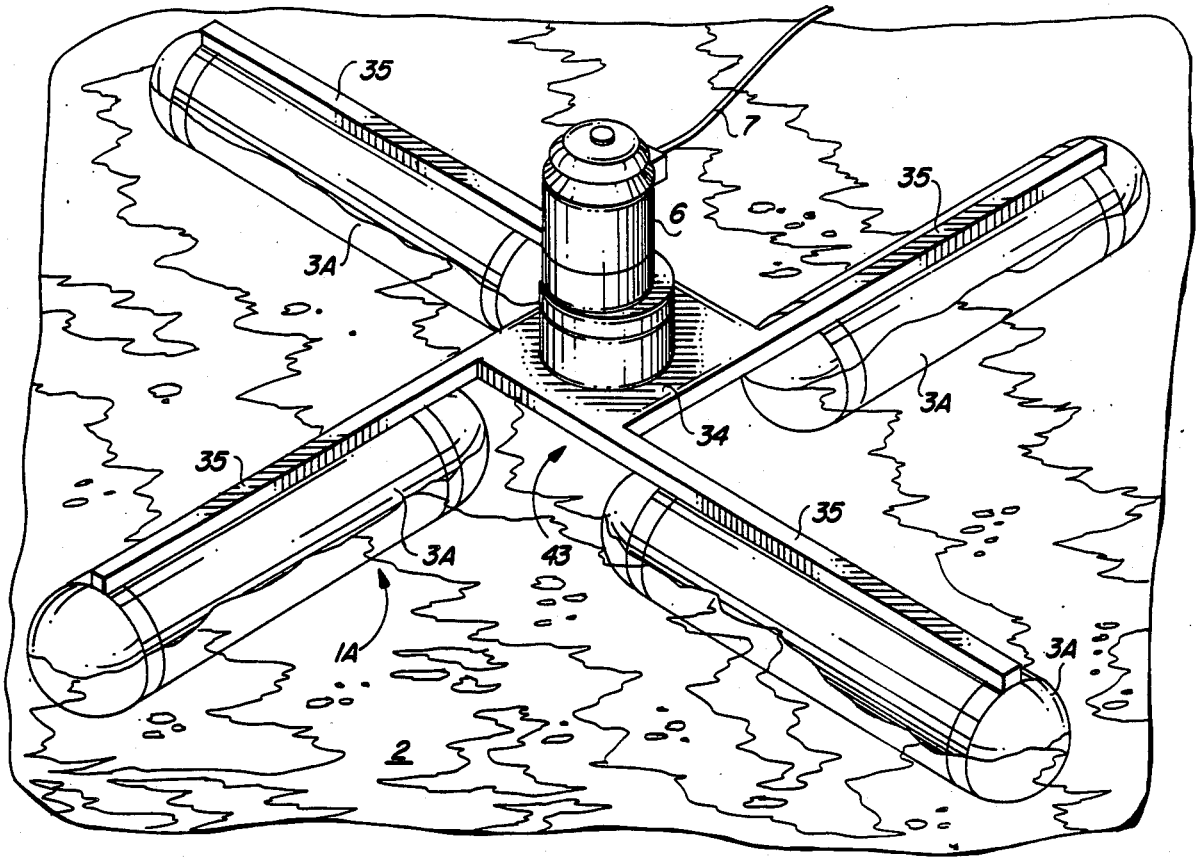
FIG. 8 is a perspective view of the aeration apparatus of the invention supported by another float structure.

Referring now to the drawings, particular FIGS. 1 and 4–7, aerator 1 includes an annular float 3 floating in a wastewater lagoon 2. A gear box 8 is connected to a 10 horsepower electric motor 6, to which electrical power is supplied by an electric cable 7. Gear box 8, which can be a 4 to 1 reduction unit, is supported by a bracket 9 having a plurality of air ducts through which outside air is drawn, as indicated by arrows 10, into a vacuum created by rotation of impeller 15 beneath the surface of wastewater lagoon 2.

Gear box 8 drives a vertical shaft 11 in the direction indicated by arrow 12. Shaft 11 supports an "air screw" 13 having a plurality of fins generally designated by reference numeral 14. Shaft 11 also supports impeller 15.

The detailed structure of air screw 13 and impeller 15 is shown in FIGS. 5–7. Impeller 15 includes a central, cylindrical hub 35 having a cylindrical bore 36 through which shaft 11 extends. Hub 35 is locked to shaft 11 by a suitable key means.

Impeller 15 has eight precisely configured vanes 16, all vertically aligned with the axis of shaft 11, and all being symmetrically arranged about and integral with hub 35. Preferably, impeller 15 is composed of TOWNPRENE plastic material, and is available as a Model TOWNPRENE 13 inch impeller manufactured by Townley Engineering, of Candler, Fla. to avoid corrosion due to acids and other corrosive substances commonly found in wastewater lagoons, especially those receiving industrial effluent.

In accordance with the present invention, the precise configuration and dimensions of impeller 15 have been selected to maximize the amount of dissolved oxygen, and are quite critical for a particular range of impeller rotation rates. The heighth of each of the vanes is 13 inches. The diameter of hub 35 is four and one-fourth inches The radial distance from the tip of the vanes 16 to the surface of hub 35 is four and three-fourths inches. The distance designated by arrow 30 is six and one-half inches. The width of the outermost portions of each of the vanes 16, designated by reference numeral 32 in FIG. 7, is one and five-eighths inches. The width of the inner or base portion of each of the vanes 16 is designated by reference numeral 31, and is 1 inch. The distance designated by reference numeral 33 designates the radial outward extent of the constant thickness portion of each of the vanes, and is approximately one and three-fourths inches.

Air screw 13 includes a cylindrical hub 27 having a bore 31 through which shaft 11 extends. Air screw 13 has three sets of four propeller-like fins. The upper set of fins 28 are the longest and widest. A second intermediate set of shorter, narrower fins 29 is attached to cylinder 27 below the upper fins 28, in the manner indicated in FIG. 6. The lowest set of four fins, which are shorter and narrower yet, are attached to the outer wall of cylinder 27 and are designated by reference numeral 30. The width of each of the fins 28 is three and one-half inches and its length is 3.7 inches. The width of each of the intermediate fins 29 is two and one-half inches and its length is 2.9 inches. The width of each of the bottom fins 30 is one and one-half inches and its length is 2.2 inches. The height of air screw cylinder 27 is about 13 inches. In order to make the air screw operational, the impeller 15 rotates in the direction of arrow 42 of FIG. 1.

Motor 6 is a 10 horsepower induction motor. It is a type C.S., constant speed, three-phase 60 cycle 440 volt four pole motor with industrial heavy duty windings. The gear reduction unit 8 is a horizontal helical type with a 4 to 1 ratio. The rotor is supported by the gear reduction unit 8 by a 3 inch 1309 New Departure roller bearing at the top thereof and a 1309Z New Departure bearing at the bottom therein.

The donut-shaped float 3 can be made of any of various fiberglass-impregnated resins of which chemical holding tanks are commonly made.

The diameter of the float 3 shown in FIG. 1 is 7 feet. The height of the outside edge is 15 inches, and the height of the inside edge bounding opening 4 is 9 inches. Float 3 is flat on top. The bottom surface 5 is sloped, providing a somewhat concave bottom structure for float 3. The diameter of the opening 4 is 17 inches. The concave bottom structure has not yet been tested, but it is believed that it will increase the depth of the zone of influence as subsequently explained.

Figure 9:
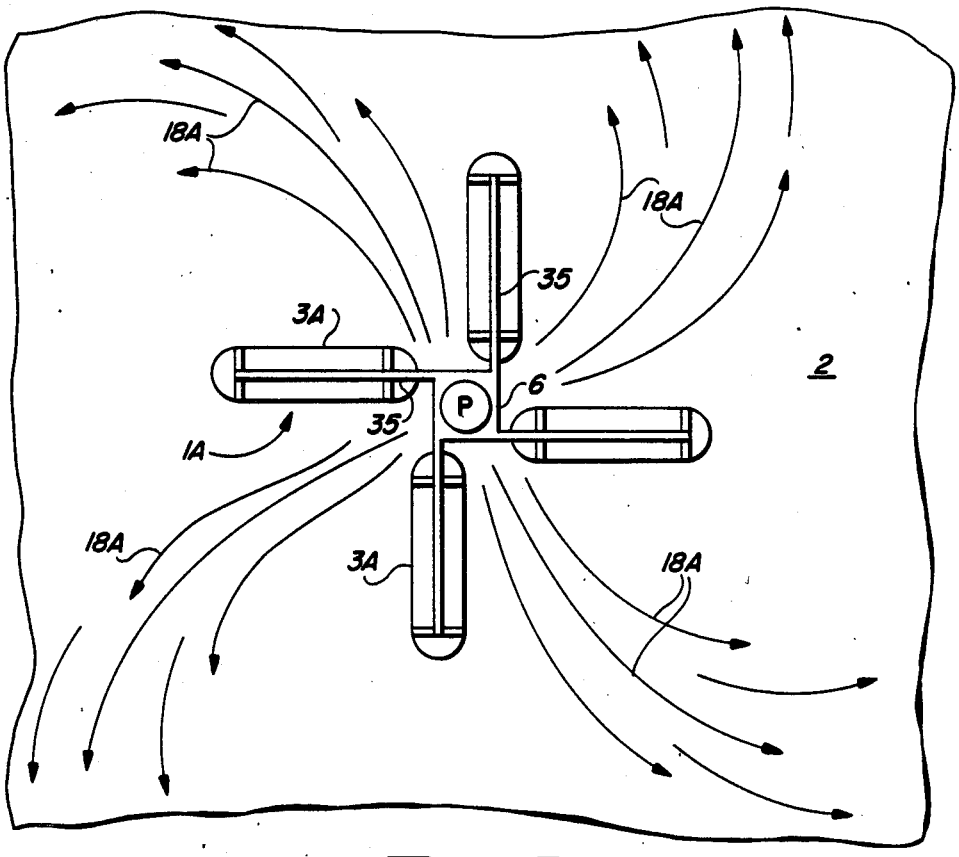
FIG. 9 is a plan view illustrating the radial pattern of air-entrained water produced by the aeration apparatus of FIG. 8.

Most of the embodiments of the invention actually constructed and tested to date utilize four elongated floats or pontoons such as 3A shown in FIGS. 8 and 9, supporting a platform 34 by means of arms 35 that are attached to the upper surfaces of the elongated floats 3A. The elongated floats 3A are oriented generally radially outward, and provide a plurality of gaps such as 43 in FIG. 8 between the inner ends of each pair of adjacent floats 3A. This "spider" configuration of the elongated floats 3A with the resulting gaps 43 has resulted in four radially outward flows or currents of the air-entrained wastewater thrust outward by the impeller 15, as shown in FIG. 9. It has not yet been determined which float configuration will be optimum. The configuration shown in FIGS. 8 and 9 produced the currents 18A extending out as far as 150 feet from the impeller 15 in a particular large deep contaminated pool. The current patterns indicated by arrows 18 are readily visible from a loft, and appear as long, slightly curved white arms extending outward from the impeller, and show up clearly in photographs of the aeration system 1A (FIG. 9) in operation.

An optional "vacuum flange" 26 can be attached to the bottom of one of the vanes 16, as indicated in FIGS. 4, 5, and 7. The angle 40 can be 45°. The length of vacuum flange 26 can be 4 inches, and the width of its sloped portion extending below the bottom of that vane 16 can be one and one-fourth inches.

It should be appreciated that the above-indicated dimensions are not all extremely critical, and other dimensions might be used indifferent circumstances, such as different rotation rates of impeller 15. However, for a range of impeller rotation rates of about 650 to 850 rpm, the optimum shape and dimensions of the impeller were empirically determined, and are quite critical, especially the height and diameter of the impeller. For example, an 11 inch high, 12 inch diameter impeller with three-quarter inch thick blades was about 20% less effective.

In order to avoid corrosion of the motor, a cast iron housing motor preferably is utilized.

The above-described device operates with a shaft 11 in the range of 650 to 850 rpm, preferably near the upper end of that range. It has been found to provide an effective radius of influence of in excess of 90 feet and a depth of influence of about 10 feet or more in a wastewater lagoon having a diameter of about 180 feet and a depth of about 10 feet. It should be noted that the radius of influence is to some extent a function of the radius of the lagoon, and will be somewhat larger for larger wastewater lagoons. In one large 30 acre lagoon that was about 60 feet deep, the radius of influence was found to be about 150 feet.

The dissolved oxygen added to one pond of 14 acres and 5 feet deep by three of the aerators of FIG. 1 has been experimentally found to be in the range from 5 to 6 pounds of dissolved oxygen per horsepower-hour. Complete mixing with the 90 foot zone of influence was determined to occur in about six and one-half minutes.

FIG. 2 shows the general circulation patterns of wastewater with large numbers of minute air bubbles entrained therein by the above aerator in one wastewater pond having a diameter of about 180 feet and a depth of about 10 feet. Reference numerals 19 indicate flow of wastewater and entrained minute air bubbles near the surface of the lagoon 2 toward the impeller 15. Reference numerals 20 designate a "scouring" loop pattern indicating dissolved oxygen being brought into contact with and mixed with sludge at the bottom of the pond, causing progressive degradation and removal of the sludge. Arrows 21 designate another similar scouring curent that results, as indicated by measurements made with a suitable commercially avalable electronic probe.

At this point, my present understanding of the operation of the device shown in FIG. 1 will be explained with reference to FIGS. 1 and 3. The top of impeller 15 is located about 14 to 15 inches below the surface 2 of the wastewater lagoon. With impeller 15 rotating at 650 to 850 RPM, water radially thrown outward in the direction of arrows 18 creates a vacuum in the regions between the blades 16 of impeller 15. This vacuum causes a swirling of the water, producing a whirlpool-like effect, sucking air through the above mentioned ducts, as indicated by arrows 10, causing it to form a vortex bounded by the whirlpool-like surface 17 of the spinning water. The vacuum between the vanes 16 thus sucks the air 10 along the shaft 11 into the vacuum region between the vanes. Meanwhile, water flows in the direction of arrows 23, downward over the tops of the vanes into the cavities between them, as a result of the suction caused by the vacuum between the vanes 16 due to the downward force of gravity. The rotation rate and configuration of the impeller is such that the air and water entering the vacuum region are "sheared" so as to cause entraining of millions of minute air bubbles in the wastewater, producing a frothy mixture. The turbulence of the incoming water and air apparently greatly increase or enhance the shearing action and greatly reduce the size of and increase the number of air bubbles entrained in the water.

More specifically, the dimensions and configuration of the impeller 15 has been empirically designed so that for the above-mentioned 10 horsepower motor 6, the 4-to-1 gear reduction box 8, and the 650 to 850 RPM rotation rate, impeller 15 seems to shear the incoming air 10 and the incoming water 23 flowing downward from the top of the impeller into the cavities between the vanes 16, producing a great deal of air and wastewater turbulence between the vanes, so that the air is broken into very minute bubbles that become entrained with the water to produce the frothy mixture.

The high rotation rate of impeller 15 produces a tremendous outward centrifugal force on the frothy mixture of minute air bubbles and water, producing a rapidly moving radial, outward flow of the frothy mixture. The air bubbles in the mixture are so minute that they do not rapidly rise to the surface, as is the case with prior aerators. Instead, the minute air bubbles remain submerged in the wastewater for a long period of time, often for hours. The many minute air bubbles thereby increase the amount of bubble wastewater surface area exposed to air, for a particular amount of power being applied to the impeller 15. The zone of influence in which the resulting currents of the air bubbles/wastewater mixture flows has been shown, both by measurements and by photographs, to often be in excess of 80 to 90 feet, and in one large wastewater lagoon, to be about 150 feet.

At the present time, it appears to me that if the rotation rate of impeller 15 is much above 850 rpm, cavitation will occur, and essentially no entraining of minute air bubbles into the water will occur, and there will be no zone of influence wherein the bubbles are thoroughly mixed and circulated within the zone of influence.

In FIG. 3, the arrows 24 designate the flow of water 23 between the vanes as it is mixed with the "sucked-in" air 10 in a highly turbulent manner. The arrows 18, and the "speckling" in FIG. 3 designate the frothy mixture of millions of minute air bubbles and wastewater being thrust radially outward by the centrifugal force imparted to the air-wastewater mixture propelled outward under the donut-shaped float 3 by impeller 15. In the embodiment of FIG. 8, the air-wastewater mixture is propelled outward between the separate radial floats 3A, as shown by arrows 18A in FIG. 9. My experiments have shown that rotation rates of much less than 650 rpm result in a loss of the "homogenizing" effect of shearing the air into minute bubbles and thoroughly mixing it with water between the vanes of impeller, about 23 inches below the lagoon top surface level.

In the described device, the diameter of the air vortex 17 at its top end is about 17 inches. The distance from the top of impeller 15 to the surface of the wastewater lagoon 2 is 14 to 15 inches. The vortex narrows down to a diameter of about 6 inches by the time it reaches the top of impeller 15.

Measurements and calculations made for the embodiment of FIG. 8 by an independent consultant indicate that if the zone of influence is about 90 feet and the depth of influence is about 4 feet, the above-described apparatus mixes the wastewater in the entire 90 foot zone of influence approximately every 6½ minutes, without the above-described air screw 13 and vacuum flange 26.

Use of the above-described air screw appears to improve the efficiency of the device about 20%. The addition of the vacuum flange 26 as described above improves the efficiency of the apparatus yet approximately another 20%.

The purpose of the downwardly sloped bottom surface 5 of the annular float 3 is to impart a downward direction to the mixture of millions of minute air bubbles and water thrust radially outward, as indicated by arrows 18 in FIG. 1, thereby increasing the depth of the zone of influence in which mixing of the wastewater with minute air bubbles occurs, and increasing the "scouring" effect of the apparatus on sludge settled on the bottom of the wastewater lagoon.

The above-described apparatus and method of FIG. 8 have been indicated by an independent consultant who performed a number of tests thereon to have a far greater radius of influence, approximately 90 feet or more, compared to the industry standard of roughly 8 feet, and provide an improvement of 5 to 6 pounds of dissolved oxygen per horsepower per hour, using only about one-tenth of the electrical energy of the typical prior devices.

Furthermore, the cost of the above-described device can be as little as Six to Ten Thousand Dollars for a unit that can provide as much dissolved oxygen in the same amount of wastewater as a prior system costing Thirty-Eight Thousand Dollars.

It is believed that the above-described aerator will reduce the amount of electrical power required for effective aeration by more than 90% compared to the most efficient known prior aeration device. The described device effectively "homogenizes" the air into the wastewater, producing minute air bubbles that remain suspended in the wastewater lagoon for very long periods of time, giving very high dissolved oxygen readings in the exit lagoons as well as in the contact lagoons. Operating time can be reduced considerably compared to prior aerators.

While the invention has been described with reference to a particular embodiment thereof, those skilled in the art will be able to make various modifications to the described embodiment of the invention without departing from the true spirit and scope thereof. For example, most of the experiments to date have been performed with a spider-like float arrangement, rather than the annular one shown in FIG. 10. The described invention will provide excellent results when supported in any fashion as long as the top of the impeller is the proper distance beneath the surface of the wastewater lagoon.

I claim:

1. A method for aerating wastewater in a lagoon, comprising the steps of:

(a) supporting an impeller by a shaft driven by an electric motor supported on a float floating on the wastewater in the lagoon, the impeller including a plurality of vertical vanes extending symmetrically and radially outward from a hub receiving the shaft, so that the impeller is submerged a predetermined distance below the surface of the lagoon;

(b) rotating the impeller to certrifugally impel wastewater outwardly between vanes of the impeller creating vacuum regions between the vanes and creating a vortex around the shaft from the surface of the lagoon to a top portion of the impeller;

(c) drawing air along the shaft through the vortex into the vacuum regions;

(d) moving wastewater into the vacuum region along with the air, and selecting the rotation rate of the impeller, the predetermined distance, and the height and width of the vanes to cause the upper edges of the vanes to effectively shear incoming air and incoming wastewater so as to produce sufficient turbulence of air and wastewater between the vanes to entrain millions of minute air bubbles into the wastewater between the vanes to produce a mixture thereof; the height of the vanes being approximately 13 inches, and (e) impelling the mixture centrifugally outwardly from the impeller to produce an outward flow of the mixture creating a zone of influence of about 90 feet around the impeller, wherein a large proportion of the millions of minute air bubbles remain entrained in the wastewater lagoon long enough to dissolve about five pounds of oxygen per horsepower per hour into the wastewater.

2. The method of claim 1 including providing an air screw mechanism on the shaft above the impeller to force air in the vortex downward into the vacuum regions between vanes of the impeller.

3. The method of claim 1 including providing a sloped flange on the bottom of one of the vanes to increase the amount of vacuum produced between the vanes.

4. The method of claim 1 including providing an annular configuration for the float and providing a downwardly, outwardly sloped bottom surface portion thereof for downwardly deflecting the mixture thrust centrifugally outward by the impeller.

5. The method of claim 1 including providing a plurality of elongated, spaced, outwardly oriented float elements supporting the motor and impeller so that currents of air-entrained wastewater are propelled outward between the float elements.

6. The method of claim 1 wherein step (a) includes supporting the impeller so that the top of the impeller is about 15 inches below the surface of the lagoon.

7. An apparatus for aerating wastewater in a lagoon, comprising in combination:

(a) a float floating on the surface of the lagoon;

(b) an impeller having a hub and eight vertical vanes extending radially, symmetrically outward from the hub; and (c) motor means on the float for driving a rotating shaft connected to the hub and supporting the impeller so that a top portion of the impeller is about 15 inches below the surface of the lagoon, the impeller rotating at a rate that causes a vacuum to be produced between the vanes and a vortex to form around the shaft from the surface of the lagoon to the top of the impeller, drawing air through the vortex and also causing the upper edges of the vanes to effectively shear incoming air and wastewater so as to produce sufficient turbulence of air and wastewater between the vanes to cause millions of minute air bubbles to be entrained in the wastewater and to cause the wastewater with entrained air bubbles to be radially expelled and create a zone of influence extending about 90 feet from the impeller, in which zone of influence a sufficient number of the minute air bubbles remain entrained long enough to dissolve about five pounds of oxygen per horsepower per hour produced by the motor means into the wastewater.

8. The apparatus of claim 7 including air screw means on the shaft above the impeller for forcing air in the vortex downward into the vacuum regions between vanes of the impeller.

9. The apparatus of claim 7 including a sloped flange attached to the bottom of one of the vanes to increase the amount of vacuum produced between the vanes.

10. The apparatus of claim 7 wherein the float is annular and has a downwardly, outwardly sloped bottom surface portion thereof for downwardly deflecting the mixture thrust centrifugally outward by the impeller.

11. The apparatus of claim 7 including a plurality of elongated, spaced, outwardly oriented float elements supporting the motor and impeller so that currents of air-entrained wastewater are propelled outward between the float elements.

12. The apparatus of claim 7 wherein the diameter of the hub is approximately four and one-half inches, and the width of the vanes is approximately five inches.

13. A method for aerating wastewater in a lagoon, comprising the steps of:

(a) supporting an impeller by a vertical shaft so that the impeller is submerged in the wastewater, the impeller having a cylindrical hub with a plurality of symmetrically positioned vertical vanes extending radially outward from the cylindrical hub;

(b) providing a sloped flange on the bottom of one of the vanes to increase the amount of vacuum produced between the vanes during rotation of the impeller;

(c) rotating the impeller to centrifugally impel wastewater outwardly between vanes of the impeller, creating vacuum regions between the vanes and producing swirling of wastewater that defines a vortex surrounding the shaft and extending from a surface of the lagoon to a top portion of the impeller;

(d) drawing air along the shaft and through the vortex into the vacuum regions;

(e) moving wastewater into the vacuum region along with the air, the rotation of the impeller causing edges of the vanes to effectively shear incoming air and incoming wastewater so as to produce sufficient turbulence of air and wastewater between the vanes to entrain millions of minute air bubbles into the wastewater to produce a mixture thereof; and (f) impelling the mixture centrifugally outwardly from the impeller to produce an outward flow of the mixture extending far beyond the impeller into the lagoon.

14. The method of claim 13 including providing an air screw mechanism on the shaft above the impeller to force air in the vortex downward into the vacuum regions between vanes of the impeller.

15. Apparatus for aerating wastewater in a lagoon, comprising in combination:

(a) an impeller supported on a vertical shaft driven by an electric motor unit supported on a float floating on the wastewater, the impeller having a plurality of vertical vanes extending radially, symmetrically outwardly from the shaft, and a sloped flange attached to the bottom of one of the vanes to increase the vacuum produced between the vanes;

(b) means for supporting the shaft so that the impeller is submerged in the wastewater and rotating the impeller to centrifugally impel wastewater outwardly between the vanes creating vacuum regions between the vanes;

(c) means for drawing air along the shaft into the vacuum region when the impeller is rotating and moving wastewater into the vacuum region along with the air so that the rotation of the impeller causes edges of the vanes to effectively shear incoming air and incoming wastewater and produce sufficient turbulence of air and wastewater between the vanes to entrain millions of minute air bubbles into the wastewater; and (d) means for impelling the mixture centrifugally outwardly from the impeller to produce an outward flow of the mixture extending far beyond the impeller into the lagoon.

* * * * *